US006743986B2

(12) United States Patent
Dirnberger

(10) Patent No.: US 6,743,986 B2
(45) Date of Patent: Jun. 1, 2004

(54) DOOR LOCK

(75) Inventor: Albert Dirnberger, Neunburg (DE)

(73) Assignee: Elektromanufaktur Zangenstein Hanauer GmbH & Co. KGAA, Nabburg (DE)

( * ) Notice: Subject to any disclaimer, the term of this patent is extended or adjusted under 35 U.S.C. 154(b) by 0 days.

(21) Appl. No.: 10/128,760

(22) Filed: Apr. 23, 2002

(65) Prior Publication Data

US 2003/0197387 A1 Oct. 23, 2003

(51) Int. Cl.[7] ..... H01H 9/24
(52) U.S. Cl. ..... 200/50.1
(58) Field of Search ..... 200/50.1, 50.12, 200/50.13, 50.02

(56) References Cited

U.S. PATENT DOCUMENTS 3,691,329 A * 9/1972 Ball ..... 200/50.12
4,342,476 A 8/1982 Brown et al.
4,461,940 A * 7/1984 Ishimura ..... 200/50.12
4,982,063 A * 1/1991 Tsunekawa et al. ..... 200/50.13
5,276,284 A * 1/1994 Carpenter ..... 200/50.12

FOREIGN PATENT DOCUMENTS

| | | |
|---|---|---|
| DE | 20 17 664 A | 10/1971 |
| DE | 39 19 458 A | 12/1990 |
| DE | 3919458 A | 12/1990 |
| DE | 196 01 230 A1 | 7/1997 |

* cited by examiner

*Primary Examiner*—Renee Luebke
(74) *Attorney, Agent, or Firm*—Clifford W. Browning; Woodard, Emhardt, Moriarty, McNett & Henry LLP

(57) ABSTRACT

A door lock provides a restart lockout function for an electrical household appliance to prevent an automatic restart by closing the appliance door again after having been opened during operation of the appliance. The door lock comprises a locking device, which in a closed position locks the door and in an open position releases the door, and a restart lockout device, which in a release state enables operation of the appliance and in a lockout state prevents operation of the appliance. Upon a changeover from its closed position to its open position, the locking device brings the restart lockout device out of its release state into its lockout state.

16 Claims, 4 Drawing Sheets

DOOR LOCK

FIELD OF THE INVENTION

The present invention relates generally to door interlocks for electrical appliances and in particular for washing machines, tumble driers and dishwashers. Specifically, the present invention relates to a door interlock with an integrated restart lockout for an electrical appliance, which, after opening of a door of the electrical appliance, prevents operation of the latter from being continued by closing the door again.

BACKGROUND OF THE INVENTION

For safety reasons it is necessary to prevent the operation of electrical appliances (e.g. domestic appliances, in particular washing machines, tumble driers, dishwashers etc.) from being independently, automatically resumed when the door of an appliance actually in operation is opened and then closed again. For said purpose, so-called restart lockouts are used, which ensure that an electrical appliance may not be operated again until a user, after closing the appliance door again, resets the electrical appliance to the operating state by means of a further measure, e.g. by pressing a start button.

In a known restart lockout a switch disposed in the region of the door (door switch) is used, which detects opening of the door. In the case of said electrical solution, the control unit of the electrical appliance is controlled by means of the door switch in a way that prevents restarting when the door is closed again.

A further known restart lockout is actuated likewise by the opening movement of the door. In said case, a mechanical solution is used, in which the door cooperates with a linkage in such a way that opening of a door by means of the linkage brings a master switch (e.g. start button, on/off switch) of an electrical appliance mechanically into a position, which interrupts operation of the electrical appliance. To resume operation, the master switch then has to be actuated once more.

A door interlock for domestic appliances is further known, in which by means of a separate actuating apparatus (Bowden cable) connected to the door interlock a master switch is mechanically brought into a state, which prevents automatic resumption of the operation of the appliance after the door is closed again.

A drawback of the restart lockouts, which are actuated by appliance doors, is that additional actuable components have to be provided in the region of the door and/or of the appliance housing. Furthermore, in the case of the electrical solution, the electrical appliance has to have an electrical control unit or electrically controllable components have to be provided for bringing the master switch mechanically into its non-actuated state. The described use of a linkage, which is actuated by door opening operations, is constructionally complex and tolerance-sensitive.

The use of an actuating apparatus, which cooperates with a door interlock, likewise entails a complex construction of the electrical appliance for connecting the actuating device to the door interlock and guaranteeing actuation of the master switch of the electrical appliance. In particular, the use of a Bowden cable makes said approach susceptible to faults and requires compliance with close tolerances.

Furthermore, in known restart lockouts detection of the open and closed state of the door is not provided.

OBJECT OF THE INVENTION

The object of the present invention is to provide a restart lockout for electrical appliances, which avoids the described drawbacks of known solutions and has small dimensions. A further object of the invention is to enable open and closed positions of a door of an electrical appliance to be determined by means of the restart lockout.

BRIEF DESCRIPTION OF THE INVENTION

In order to achieve said object, the invention provides a door interlock with a restart lockout for an electrical appliance, in particular for a washing machine, a tumble drier or a dishwasher.

The door interlock according to the invention comprises an interlocking device, which in a closed position interlocks a door of an electrical appliance and in an open position releases the door. The interlocking device may be, for example, a rotary latch closure having a rotary member, which in a closed position is capable of blocking a closing piston by means of a lug and in an open position releases the closing piston, and having a catch, which in a blocking position blocks the rotary member in its closed position and in a release position releases the rotary member for a rotational movement into its open position. For the interlocking device it is also possible to use a closure with longitudinal bolt.

The door interlock according to the invention further comprises a restart lockout device, which in a release state enables operation and in particular restarting of the electrical appliance and in a lockout state interrupts operation of the electrical appliance or prevents restarting. In order, after opening of the door of the electrical appliance, to prevent automatic restarting of the electrical appliance by closing the door again, upon a changeover from the closed position to the open position of the interlocking device the restart lockout device is brought from its release state into its lockout state.

In order to enable (re)starting of the electrical appliance independently of the time, at which the interlocking device changed over into its closed position, the restart lockout device is brought into the release state independently of the changeover of the interlocking device from the open position into its closed position. For said purpose a control signal of the electrical appliance may be used, which is produced e.g. by actuating a master switch or pressing an on/off button, and is operated in such a way that the restart lockout device adopts its release state.

It is further provided that for said purpose an actuator is used, which effects the changeover of the restart lockout device into its release state. Examples of such actuators are electrically controlled actuators (e.g. mechanically acting relays), electromagnetic components (e.g. magnets), piezostrictively operated units and the like.

The change of state of the restart lockout device is preferably effected by means of a mechanical working connection, which exists at least for the period of the change of state, between the interlocking device and the restart lockout device. To said end, the restart lockout device comprises a first actuating member, which in the release state occupies a release position and in the lockout state occupies a lockout position.

For producing an electrical signal, which indicates the activation of the restart lockout, the first actuating member actuates a switch or button, which produces a suitable signal. Depending on the type of switch or button used (e.g. microswitch, micro pushbutton, tumbler switch, slide switch, etc.), the first actuating member cooperates with the switch or button in its release position and/or in its lockout position. A signal thus produced may also be used to indicate whether the door interlock and hence the appliance door is open and/or closed.

The release state for the restart lockout device is preferably achieved by a movement of the first actuating member into the latter's release position. For said purpose it is possible to use the actuator, which moves the first actuating member from its lockout position into its release position.

In order to determine whether the door of the electrical appliance is open or closed, the door interlock comprises a second actuating member, which in the closed position of the interlocking device occupies a closed position and in the open position of the interlocking device occupies an open position.

When only the first actuating member is used, the interlocking device upon a changeover from its closed position to its open position brings the first actuating member into the latter's lockout position.

When both actuating members are used, then, starting from the release state, the lockout state of the restart lockout device may be achieved in that the interlocking device upon a changeover from its closed position to its open position cooperates with the second actuating member in such a way that the second actuating member is brought from its closed position into its open position and, in the process, causes a change of position of the first actuating member from the latter's release position to the latter's lockout position.

Alternatively, it is provided that the interlocking device upon a changeover from its closed position to its open position brings the first actuating member out of the latter's release position into the latter's lockout position, wherein the second actuating member is brought from its closed position into its open position.

In the case of the last-described forms of construction, it is necessary for the first and/or the second actuating member to be of an appropriate design to guarantee the described cooperation. For said purpose it is possible to use e.g. drivers, detents, lugs, etc., which are formed on the first and/or the second actuating member.

In contrast to the first actuating member, the second actuating member takes up its closed position when the interlocking device has changed over into its closed position. Said change of position of the second actuating member is preferably achieved through cooperation with the interlocking device.

To detect the position of the second actuating member a switch or pushbutton may be used, which, in a comparable manner to the switch or pushbutton actuable by the first actuating member, is actuated by the second actuating member in the latter's closed position and/or the latter's open position.

If the first actuating member is to be secured in its release position, then a device acting substantially independently of the interlocking device is required. For said purpose it is possible to use e.g. a locating spring, which secures the first actuating member in its release position. The locating spring may also be used to hold the first actuating member in the latter's lockout position. Alternatively, it is provided that the securing in the lockout position is provided by means of a suitable working connection to the interlocking device.

As the positions of the second actuating member are dependent upon the positions of the interlocking device, it is possible, where desired, to achieve a securing of the second actuating member in its closed position and its open position by means of a corresponding working connection to the interlocking device. To hold the second actuating member in its closed position or in its open position a locating spring may also be used. Preferably, for securing the first actuating member and the second actuating member a common device, e.g. a locating spring, is used.

It is moreover to be preferred that the components of the previously described forms of construction of the door interlock according to the invention are integrated in the form of a constructional unit in a housing.

According to the invention, therefore, the restart lockout is situated in the closure or in the immediate vicinity of the latter and the restart lockout is brought by means of the interlocking element of the closure indirectly or directly into a first stable position as well as by means of an electromagnet into a second stable position. Thus, the invention makes it possible for e.g. a rotary latch closure or a closure with longitudinal bolt to be easily extended by the function of a restart lockout. It is therefore possible in a simple and inexpensive manner to provide a reliable restart lockout also in machines, which have only simple electronic equipment (or even no electronic equipment at all).

BRIEF DESCRIPTION OF THE DRAWINGS

In the following description of preferred forms of construction reference is made to the accompanying drawings, which show.

DESCRIPTION OF PREFERRED FORMS OF CONSTRUCTION

Figure 1:
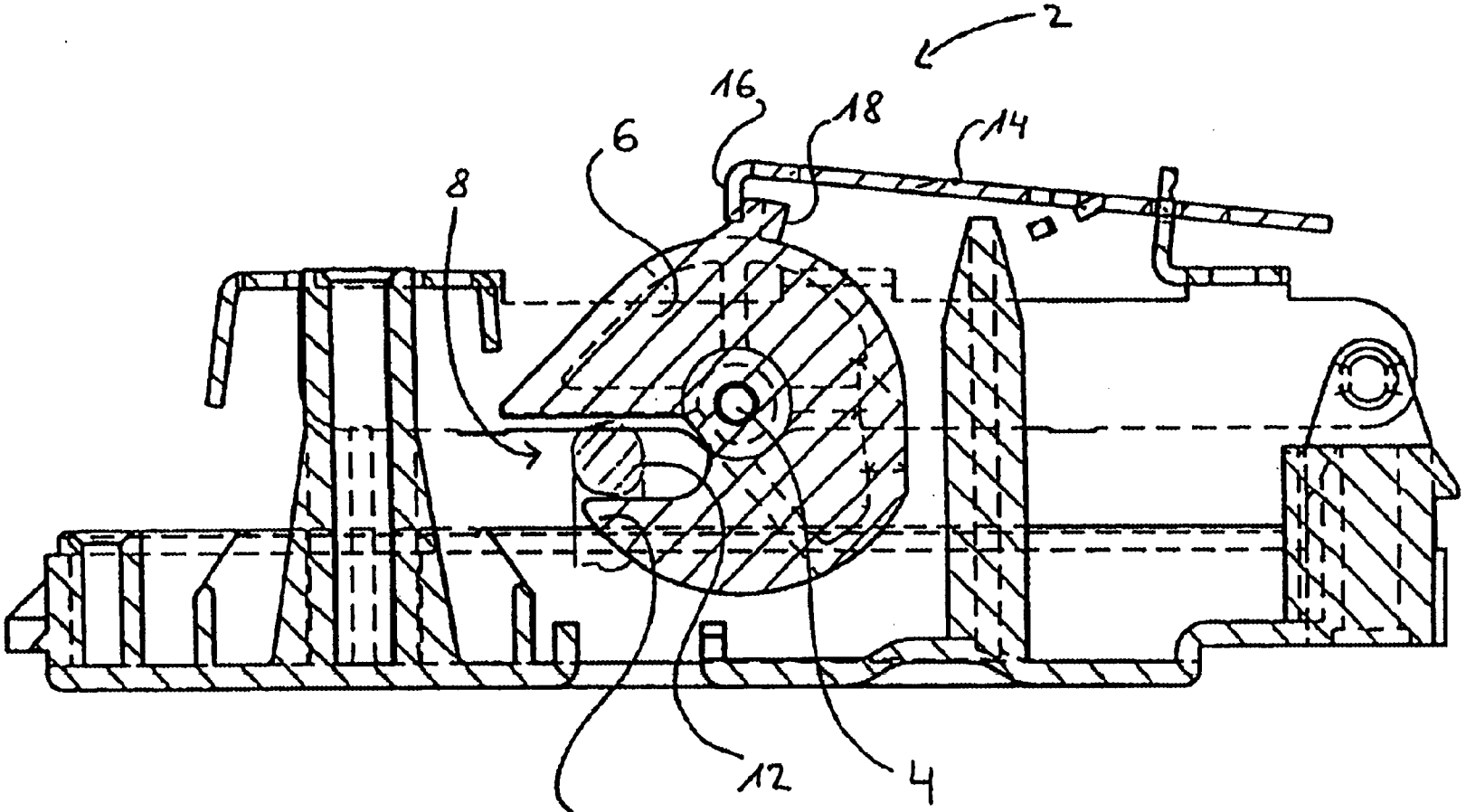
FIG. 1 a diagrammatic cross-sectional view of an interlocking device for use in a door interlock according to the invention, FIG. 2 a diagrammatic view of a form of construction of a restart lockout device according to the invention, for illustrating the principle according to the invention, FIG. 3 a perspective view of a form of construction of a door interlock according to the invention, and FIG. 4 a perspective view of the door interlock according to the invention of FIG. 3, wherein the interlocking device and the second actuating member have been omitted.

In the forms of construction of a door interlock described below an interlocking device 2 is used, which is partially diagrammatically illustrated in FIG. 1. A detailed description of such an interlocking device, which is also referred to as a rotary latch interlock, is to be found in DE 39 19 458 C2. For a better understanding, the essential features of the mode of operation of the interlocking device 2 are described below.

The interlocking device 2 comprises a rotary member 6, which is rotatable about an axis of rotation 4. By means of a lug 10, which is disposed adjacent to a recess 8, the rotary member 6 blocks a closing piston 12 when the rotary member is situated in its closed position shown in FIG. 1. In the closed position a catch 14 engages with an angled lug 16 in such a way into a sliding-block guide 18 of the rotary member 6 that the rotary member 6 is blocked in its closed position. In the state of the interlocking device 2 shown in FIG. 1 a door (not shown) of an electrical appliance may be interlocked.

To deactivate the interlocking device 2 in order to open the appliance door, the catch 14 is brought into a release position, in which it releases the rotary member 6. For said purpose, the catch 14 is brought into its release position by means of a non-illustrated mechanical device or is moved by means of the sliding-block guide 18 in such a way that it takes up its release position when by virtue of a pressure upon the appliance door the closing piston 12 moves the rotary member 6 in, according to FIG. 1, clockwise direction. As soon as the catch 14 releases the rotary member 6 for a rotational movement, the rotary member 6 is rotated by means of a non-illustrated spring in, according to FIG. 1, anticlockwise direction, thereby releasing the closing piston 12. The appliance door may then be opened.

To provide the desired restart lockout function a restart lockout device is used, which is integrated in the form of a constructional unit with the interlocking device 2 in a non-illustrated housing of a door interlock. The basic mode of operation of the restart lockout device as well as the appropriate components of the latter are described with reference to FIG. 2.

Figure 2:
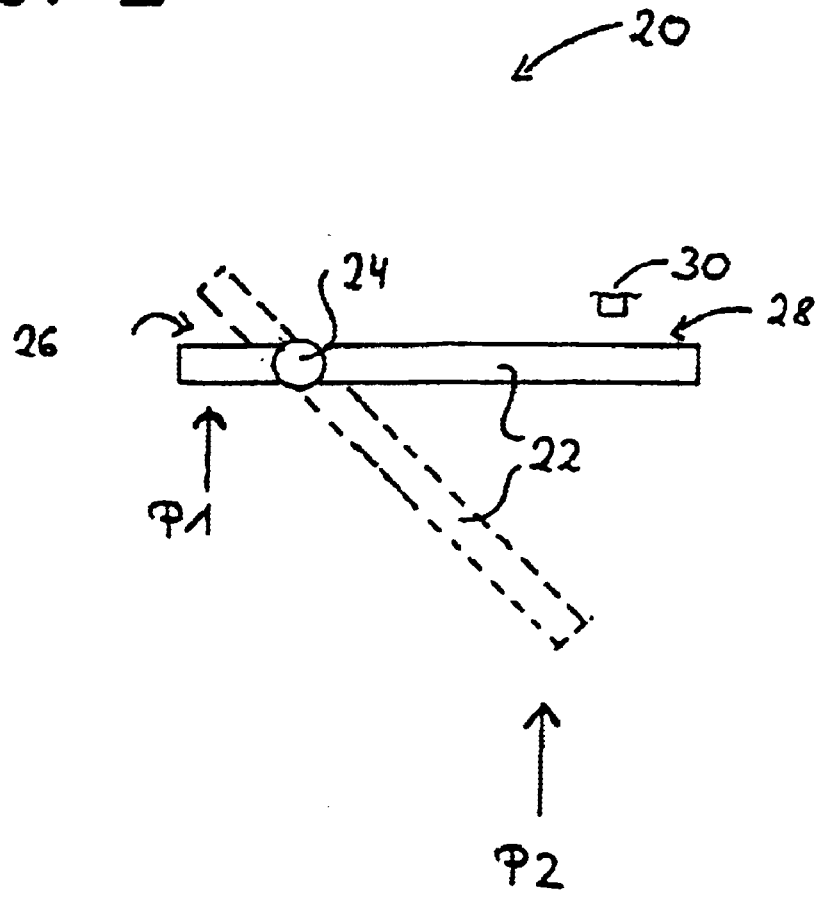

The restart lockout device generally denoted by 20 in FIG. 2 comprises a first actuating member 22, which is supported so as to be rotatable about an axis of rotation 24. The first actuating member 22 has, at one side of the axis of rotation 24, a first end 26 and, at the other side of the axis of rotation 24, a second end 28 lying opposite the first end 26.

The first actuating member 22 illustrated by unbroken lines in FIG. 2 is situated in a lockout position, which characterizes a lockout state for the restart lockout device 20. The first actuating member 22 illustrated by dashes is situated in a release position, which defines a release state for the restart lockout device 20.

When for starting of an electrical appliance, in which the door interlock is used, the appliance door is closed and the interlocking device 2 therefore changes over from its open position to its closed position, the restart lockout device 20 is situated in its lockout state, i.e. the first actuating member 22 is situated in its lockout position. In order to start the actual operation of the electrical appliance, a user of the electrical appliance controls the latter, e.g. by actuating a switch or pushbutton. In response thereto, a force is exerted, e.g. through use of an electromagnetic actuator, in the direction of the arrow P1 upon the first end 26 of the first actuating member 22 so that the first actuating member 22 is rotated into its release position. Said position of the first actuating member 22 is detected before the electrical appliance is actually set in operation.

For determining the release position of the first actuating member 22 a switch 30, more precisely a micro pushbutton, is used, which is released upon the changeover of the first actuating member 22 from the latter's lockout position to the latter's release position. The signal thus produced indicates to a non-illustrated control unit of the electrical appliance that the actuating member 22 is in its release position and the electrical appliance may be started. Alternatively it is possible that for said purpose the first actuating member 22, when it changes over into its release position, actuates the switch 30.

If the appliance door is subsequently opened and the interlocking device 2 is therefore deactivated, movements of individual components of the interlocking device 2 and, in particular, of the rotary member 6 are used to exert a force in the direction of the arrow P2 upon the second end 28 of the first actuating member 22. This has the result that the first actuating member 22 is moved from its release position into its lockout position and actuates the switch 30 (alternatively: on leaving the release position releases the switch 30).

The actuation of the switch 30 (alternatively: the release of the switch 30) produces a signal, which sets the control unit of the electrical appliance into a state, in which the electrical appliance may not be restarted or in which operation is automatically resumed when the door is closed again. For resumed operation, further measures by the user are required, such as e.g. renewed actuation of the on/off switch or pushbutton.

Figure 3:
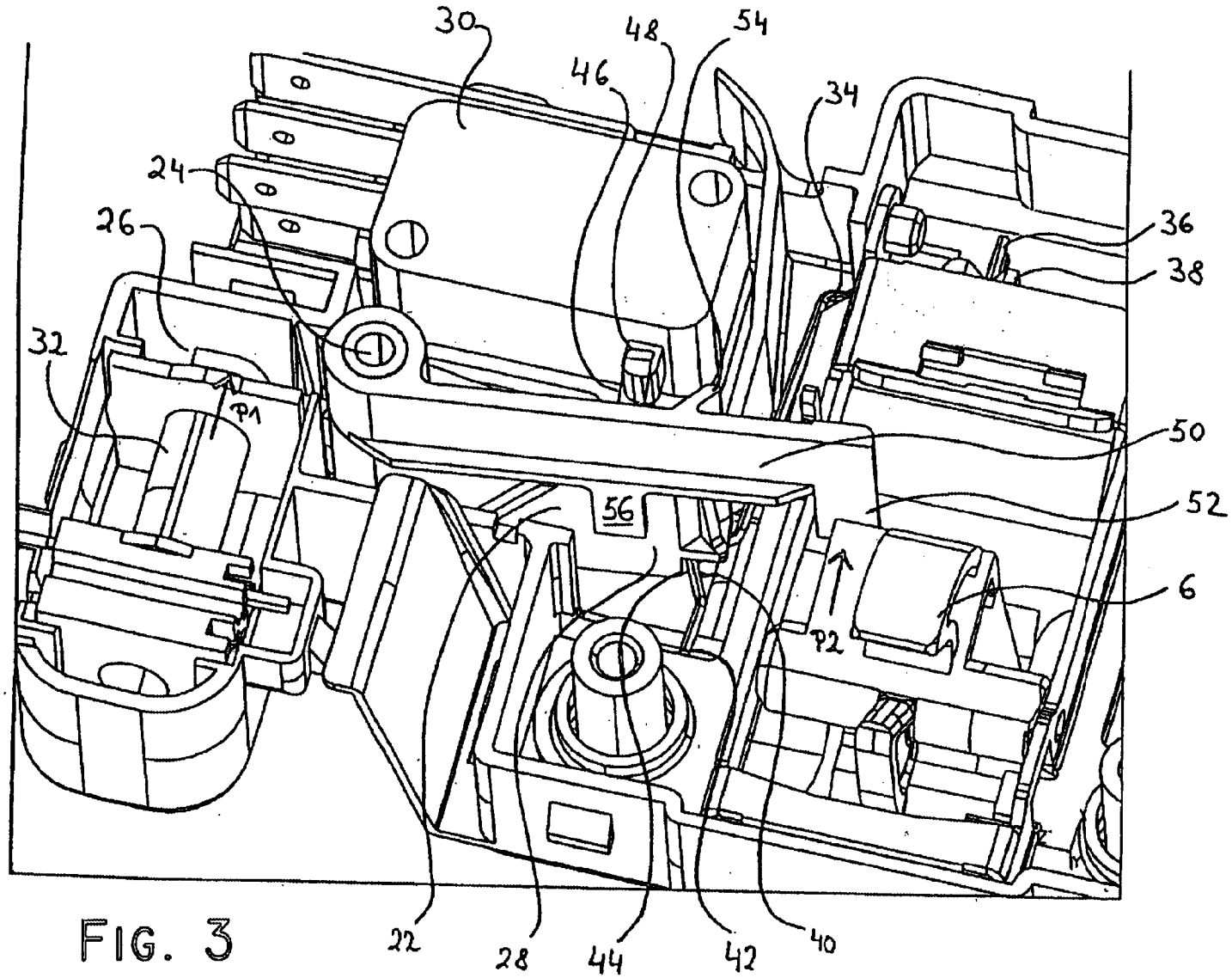
Figure 4:
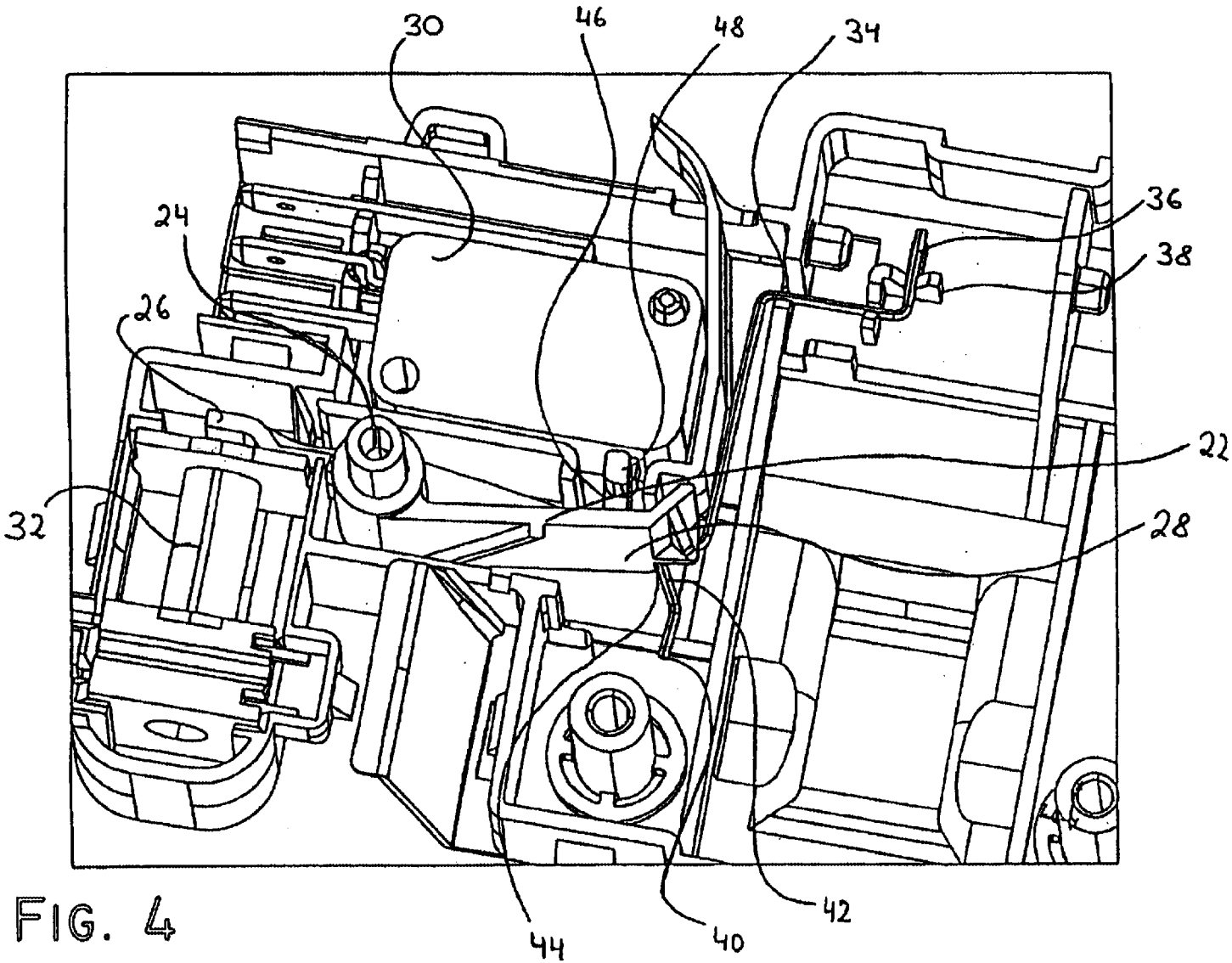

There now follows a description with reference to FIGS. 3 and 4 of a form of construction of a door interlock, which prevents unwanted restarting of an electrical appliance and detects whether an appliance door is open or closed.

The door interlock illustrated in FIG. 3 comprises the interlocking device 2 from FIG. 1. Of the latter, only the rotary member 6 is labelled here because the rotary member 6, or more precisely its movements are used to operate the restart lockout device 20.

For the introduction of force, described with reference to FIG. 2, in the direction of the arrow P1 into the first end 26 of the first actuating member 22 an electromagnet 32 is used, which by means of a non-illustrated component for rotation of the first actuating member 22 cooperates with the first end 26. When, given the preconditions and motional sequences described above, the first actuating member 22 is to be brought from its lockout position into its release position, the electromagnet 32 is activated by a pulse so that the component of the electromagnet 32 cooperating with the first end 26 releases the first end 26 when the first actuating member 22 is situated in its release position. Said release of the first end 26 allows unimpeded rotation of the first actuating member 22 back into its lockout position. As an alternative to pulse control of the electromagnet 32, the signal produced by the switch 30 may also be used to control the electromagnet 32.

A spring 34 is used to secure the first actuating member 22 in its release position. The spring 34 is fastened by one spring end 36 by means of a clamping device 38 to an inner side of a housing (not labelled) for the door interlock. The spring 34 serving as a locating spring comprises a detent 40. A free spring end 42 lying opposite the spring end 36 allows an elastic movement of the spring 34 upon positional changes of the first actuating member 22.

The first actuating member 22 at its second end 28 is designed in such a way that the detent 40 in the release position engages into the second end 28 in order to secure the first actuating member 22 in the release position. Said securing of the first actuating member 22 prevents an unwanted changeover into its lockout position.

The spring 34 is likewise used to hold the first actuating member 22 in its lockout position, wherein the detent 40 engages into an end face 44 on the second end 28.

In its lockout position the first actuating member 22 via a lug 46 contacts a pushbutton 48 of the switch 30. When the first actuating member 22 is moved out of the lockout position, the pushbutton 48 is brought by a non-illustrated spring of the switch 30 into a non-actuated position. In response thereto, the switch 30 produces a signal which, in the manner described above, enables actual starting of the electrical appliance.

The door interlock further comprises a second actuating member 50, which is likewise supported so as to be rotatable about the axis of rotation 24. At its opposite end to the axis of rotation 24 the second actuating member 50 has an actuating tongue 52. A lug 54 and a driver 56 are moreover disposed on the second actuating member 50.

The second actuating member 50 here performs two functions, namely, on the one hand, determination of the position of the interlocking device 2 and hence of the state of the appliance door and, on the other hand, the introduction of force into the second end 28 of the first actuating member 22 in order to move the latter from its release position into its lockout position.

Whereas the first actuating member 22 is brought by means of the electromagnet 32 into its release position independently of the time, at which the interlocking device 2 takes up its closed position, the positions of the second actuating member 50 are changed in dependence upon the positions of the interlocking device 2. Upon a changeover of the interlocking device 2 from its closed position to its open position, the rotary member 6 is rotated and, in the process, contacts the actuating tongue 52. A force is therefore exerted in the direction of the arrow P2 upon the second actuating member 50 and causes rotation of the latter in, according to FIG. 3, anticlockwise direction.

When the interlocking device 2 is situated in its open position, a non-illustrated switch is actuated by means of the lug 54. In said manner a signal is produced, which indicates to the control unit of the electrical appliance that the interlocking device 2 is deactivated and consequently the appliance door is open.

Upon interlocking of the interlocking device 2, i.e. upon a changeover from the open position to the closed position, the second actuating member 50 is brought by means of a non-illustrated spring out of the previously described open position into a closed position. In said case, the switch previously actuated by the lug 54 is released, thereby producing a signal, which indicates that closing of the appliance door has been effected. The spring force used for the positional change of the second actuating member 50 may, in a comparable manner to the spring of the switch 30, be generated by a spring of the switch, which cooperates with the lug 54.

When the appliance door is closed, the second actuating member 50 is situated in its closed position and the interlocking device 2 is situated in its closed position. The first actuating member 22, as described above, remains situated in its lockout position until it is moved into its release position by means of the electromagnet 32 and secured there by the locating spring 34. The electrical appliance may then be set in operation.

If the appliance door is then opened again and the interlocking device 2 is therefore brought into its open position, the second actuating member 50 is moved in the manner described above from its closed position into its open position. In said case, the driver 56 contacts the first actuating member 22 in a region at the second end 28. This gives rise to a rotation of the first actuating member 22 out of its release position into its lockout position. The signal, which is produced by the switch 30 upon attainment of the lockout position of the first actuating member 22, is then used to prevent an unwanted, automatic restarting of the electrical appliance when the appliance door is closed again.

What is claimed is:

1. Door lock with a restart lockout for an electrical household appliance having a door, comprising:

a locking device having a closed position in which the door is locked and an open position in which the door is unlocked, a restart lockout device having a release state in which the electric household appliance is operable and a lockout state in which the household appliance is inoperable, means for engaging the restart lockout device when the locking device changes over from the closed position to the open position and for moving the restart lockout device from the release state into the lockout state in response to the changeover from the closed position to the open position, and means for changing over the locking device from the open position into the closed position free of engagement with the restart lockout device so as to maintain the restart lockout device in its lockout state upon a changeover of the locking device from the open position into the closed position.

2. Door lock according to claim 1, further comprising means for changing over the restart lockout device into the release state when the electrical household appliance is correspondingly controlled for operation of the latter.

3. Door lock according to claim 1, wherein the locking device and the restart lockout device are integrated in the form of a constructional unit in a housing.

4. Door lock according to claim 1 for a washing machine, a tumble drier or a dish washer.

5. Door lock according to claim 1, wherein the means for engaging and moving the restart lockout device comprises a first actuating member having a release position in the release state of the restart lockout device and having a lockout position in the lockout state of the restart lockout device.

6. Door lock according to claim 5, further comprising a first switch actuated by the first actuating member in the release position or in the lockout position.

7. Door lock according to claim 5, further comprising an actuator for moving the first actuating member out of the lockout position into the release position.

8. Door lock according to claim 5, wherein the means for engaging and moving the restart lockout device comprises a second actuating member having a closed position in the closed position of the locking device and having an open position in the open position of the locking device.

9. Door lock according to claim 5, wherein the means for engaging and moving the restart lockout device comprises a second actuating member for moving the first actuating member into its lockout position upon a changeover of the locking device from the closed position to the open position.

10. Door lock according to claim 5, wherein the means for engaging and moving the restart lockout device comprises a second actuating member having a closed position in the closed position of the locking device and having an open position in the open position of the locking device, the first actuating member for moving the second actuating member into its open position upon a changeover of the first actuating member from its release position to its lockout position.

11. Door lock according to claim 5, wherein in the means for engaging and moving the restart lockout device comprises a second actuating member having a closed position in the closed position of the locking device and having an open position in the open position of the locking device, the second actuating member for changing over into its closed position upon a changeover of the locking device from its open position to its closed position.

12. Door lock according to claim 5, further comprising a second switch, wherein the means for engaging and moving the restart lockout device comprises a second actuating member having a closed position in the closed position of the locking device and having an open position in the open position of the locking device, the second actuating member for actuating the second switch in its closed position or its open position.

13. Door lock according to claim 5, further comprising a locating spring for holding the first actuating member in the release position or in the lockout position.

14. Door lock according to claim 5, further comprising a locating spring, wherein the means for engaging and moving the restart lockout device comprises a second actuating member having a closed position in the closed position of the locking device and having an open position in the open position of the locking device, the locating spring for holding the second actuating member in its closed position or open position.

15. Door lock according to claim 5, wherein the locking device comprises means for moving the first actuating member into its lockout position upon a changeover of the locking device from the closed position to the open position.

16. Door lock according to claim 15, wherein the means for moving the first actuating member comprises an actuating tongue.

* * * * *